US008613157B2

(12) United States Patent
McCaffery

(10) Patent No.: US 8,613,157 B2
(45) Date of Patent: Dec. 24, 2013

(54) DETACHABLE RIFLE-MOUNTED AMMUNITION CARRIER AND METHODS OF USE

(76) Inventor: Eric K. McCaffery, Farmington, NM (US)

( * ) Notice: Subject to any disclaimer, the term of this patent is extended or adjusted under 35 U.S.C. 154(b) by 132 days.

(21) Appl. No.: 13/239,780

(22) Filed: Sep. 22, 2011

(65) Prior Publication Data

US 2013/0074392 A1 Mar. 28, 2013

(51) Int. Cl.
*F41C 27/00* (2006.01)

(52) U.S. Cl.
USPC ..... 42/99; 42/90; 224/931

(58) Field of Classification Search
USPC ..... 42/90, 99; 89/34; 206/3, 818; 220/483; 224/183, 562, 931; 248/206.5, 207, 248/683
See application file for complete search history.

(56) References Cited

U.S. PATENT DOCUMENTS

| | | | | | |
|---|---|---|---|---|---|
| 2,372,685 | A | * | 4/1945 | Schaich | 89/35.01 |
| 2,928,530 | A | * | 3/1960 | Sauey | 206/3 |
| 4,194,657 | A | * | 3/1980 | Thor | 224/667 |
| 4,481,561 | A | * | 11/1984 | Lanning | 362/111 |
| 4,702,016 | A | * | 10/1987 | Grigsby et al. | 34/499 |
| 4,826,059 | A | * | 5/1989 | Bosch et al. | 224/183 |
| 5,056,661 | A | * | 10/1991 | Balzano | 206/372 |
| D325,952 | S | * | 5/1992 | Moore | D22/108 |
| 5,121,564 | A | | 6/1992 | Story | |
| 5,261,178 | A | | 11/1993 | Samish | |
| 5,370,288 | A | * | 12/1994 | Field | 224/223 |
| 5,577,697 | A | * | 11/1996 | Accordino | 248/206.5 |
| 5,598,923 | A | * | 2/1997 | Owens | 206/370 |
| 5,623,769 | A | * | 4/1997 | Hayden | 34/61 |
| 5,813,157 | A | | 9/1998 | Scott | |
| 5,934,464 | A | * | 8/1999 | Vargo et al. | 206/315.11 |
| 6,176,407 | B1 | * | 1/2001 | Jones et al. | 224/584 |
| 6,253,481 | B1 | | 7/2001 | Melby | |
| 6,267,484 | B1 | * | 7/2001 | Baker et al. | 362/156 |
| 6,374,719 | B1 | * | 4/2002 | Phillips | 89/34 |
| 7,559,445 | B1 | * | 7/2009 | Kulp | 224/627 |
| 7,918,371 | B2 | * | 4/2011 | Wilson | 224/196 |

(Continued)

FOREIGN PATENT DOCUMENTS

| | | |
|---|---|---|
| WO | WO2011015854 | 2/2011 |

OTHER PUBLICATIONS

S.O.E Tactical Gear 12ga PALS Tray. <http://web.archive.org/web/20100315022423/http://www.originalsoegear.com/12palstray.html>. Mar. 15, 2010.*

(Continued)

*Primary Examiner* — Gabriel Klein
(74) *Attorney, Agent, or Firm* — Leyendecker & Lemire, LLC

(57) ABSTRACT

The present inventive concept is generally directed to a magnetic, detachable, side-mounted, ammunition carrier for a gun, specifically for a rifle or shotgun. Generally speaking, the carrier is detachably located by a user on one of the sides of ammunition-chamber loading region of a rifle or shotgun. In an embodiment, the ammunition carrier is comprised of a substantially rigid, magnetic substrate on which is a plurality of flexible, elastic, radially closed, loops/sleeves that are each adapted to receive a shotgun shell or other round of ammunition. The ammunition carrier allows for the easy mounting and access of extra ammunition without having to modify the firearm from its original equipment manufacturer (OEM) configuration. In some variations, the ammunition carrier is further equipped with a non-magnetic tab of sorts to aid a user in the easy detachment of the device from the metal side of the firearm.

20 Claims, 7 Drawing Sheets

(56) References Cited

U.S. PATENT DOCUMENTS

| | | | | |
|---|---|---|---|---|
| 2004/0222258 | A1 | 11/2004 | Ho | |
| 2006/0113347 | A1 | 6/2006 | Link | |
| 2007/0059114 | A1* | 3/2007 | Grimes | 408/238 |
| 2010/0176174 | A1 | 7/2010 | Felts | |
| 2010/0219217 | A1* | 9/2010 | Andochick | 224/250 |

OTHER PUBLICATIONS

DIY Shotgun Sidesaddle Velcro conversion. <http://web.archive.org/web/20090502164329/http://www.freewebs.com/socal_webshooters/diy_shotgun_side_saddle_velcro.htm>. May 2, 2009.*

Crazy Sidesaddle Mounting Idea. <http://www.thehighroad.org/archive/index.php/t-532341.html>. Jul. 8, 2010.*

Red Tac Gear 12 gauage Ammo Card. <http://www.redtacgear.com/viewtopic.php?f=8&t=15>. Jul. 31, 2009.*

Detachable Side Ammo Carrier (DSAC) by Vang Comp Systems, described at http://www.shop.vangcomp.net/product.sc?productId=45 (last accessed on Sep. 16, 2011).

Receiver Mount SureShell Shotshell Carriers by Mesa Tactical, described at http://www.mesatactical.com/index.php?id=56 (last accessed on Sep. 16, 2011).

* cited by examiner

DETACHABLE RIFLE-MOUNTED AMMUNITION CARRIER AND METHODS OF USE

BACKGROUND

Various devices/schemes exist to aid hunters in carrying extra ammunition, while also attempting to provide relatively quick and easy access to that ammunition. Hunter's are often working their way through brush with their rifles and need to be able to access their equipment relatively easily with minimal physical hang-ups in the field. Many proposed solutions exist, with some providing built-in structures in a gun stock, a hunter's utility belt, or a carrier device that is attached to a lanyard to wear around a hunter's neck. Typically, these solutions are not very robust in that they are limited to carrying ammunition, are very rigid and often are hard-mounted onto a rifle or shotgun, and are not readily swapped out for fresh holders containing unspent ammunition.

What is needed is a new system that facilitates multi-uses for carrying hunter equipment and other paraphernalia, is easy to securely-yet-removably install ammunition shells and/or other equipment, and can be detachably mounted on a rifle or shotgun in an area that is convenient for the hunter.

DETAILED DESCRIPTION

Overview

Figure 1A:
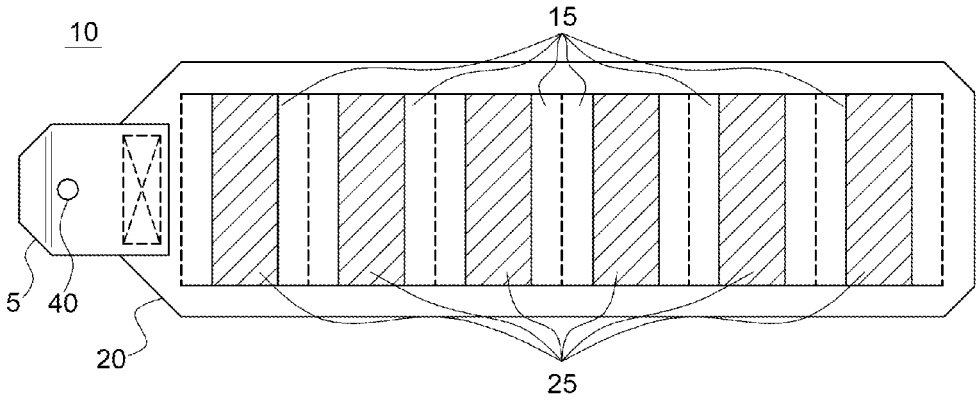
FIG. 1A depicts one embodiment of the top view of the design of an ammunition holder with six ammunition-shell holder members disposed in it.
Figure 1B:
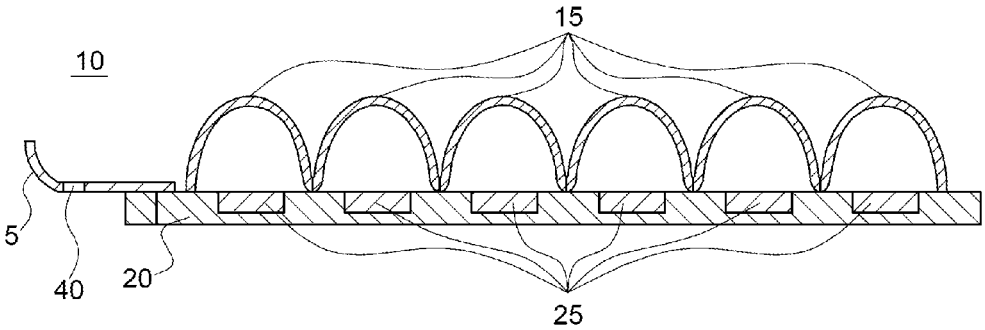
FIG. 1B depicts one embodiment of the side view of the design of an ammunition holder with six ammunition-shell holder members disposed in it.
Figure 2A:
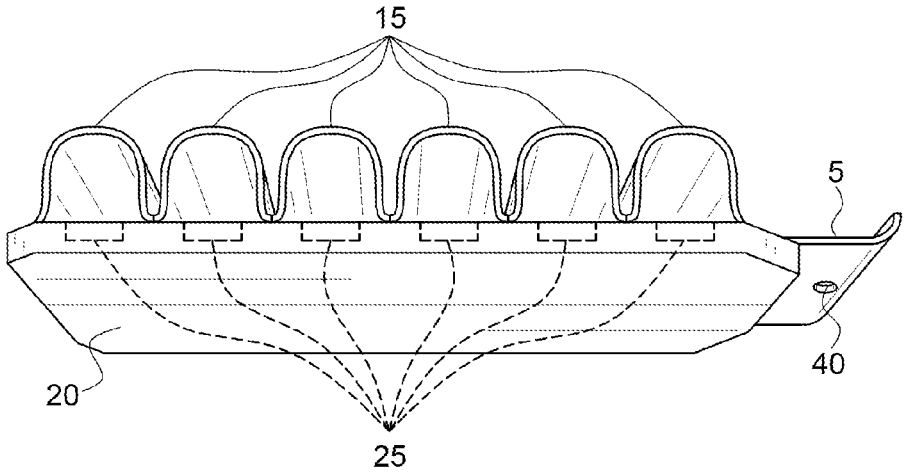
FIG. 2A depicts one embodiment of an ammunition holder as seen from the bottom-side of the ammunition holder member.
Figure 2B:
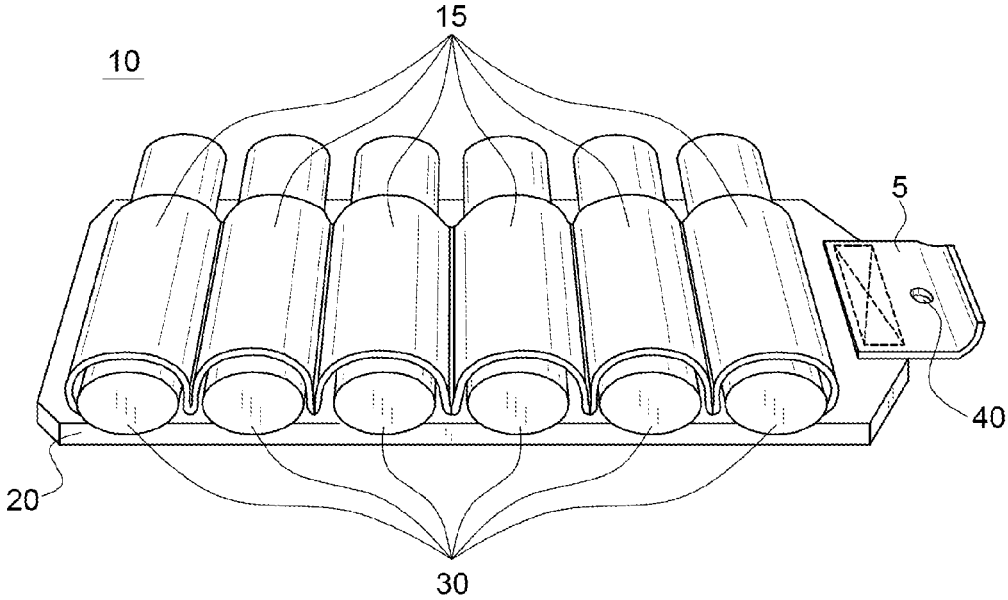
FIG. 2B depicts one embodiment of an ammunition holder from the top-side perspective, with shotgun shells installed in each flexible shell-holding sleeve/tube.
Figure 3A:
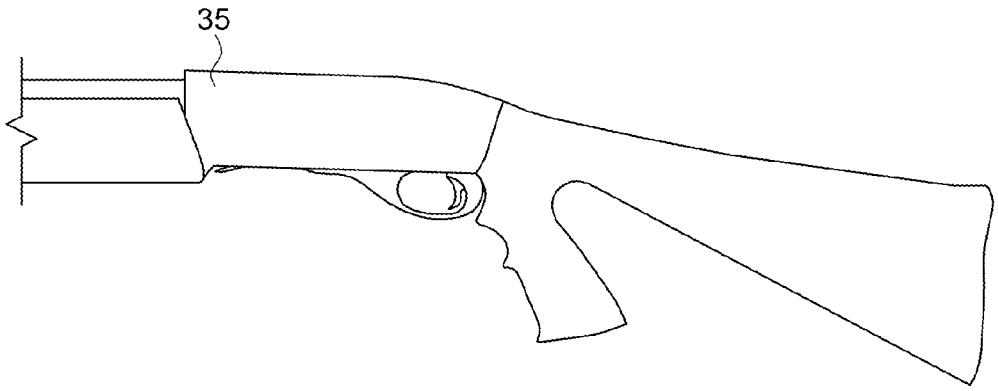
FIG. 3A depicts an example shotgun without an ammunition holder installed on the side of its receiver area, from the side view, according to one embodiment.
Figure 3B:
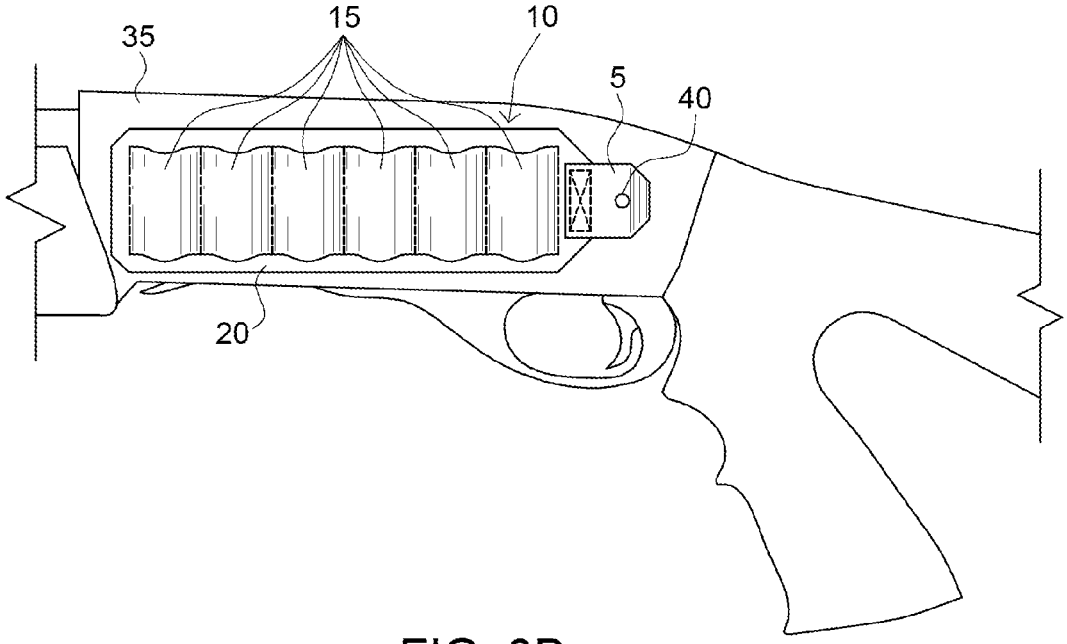
FIG. 3B depicts an example shotgun with an ammunition holder installed on the side of its receiver area, from the side view, according to one embodiment.
Figure 3C:
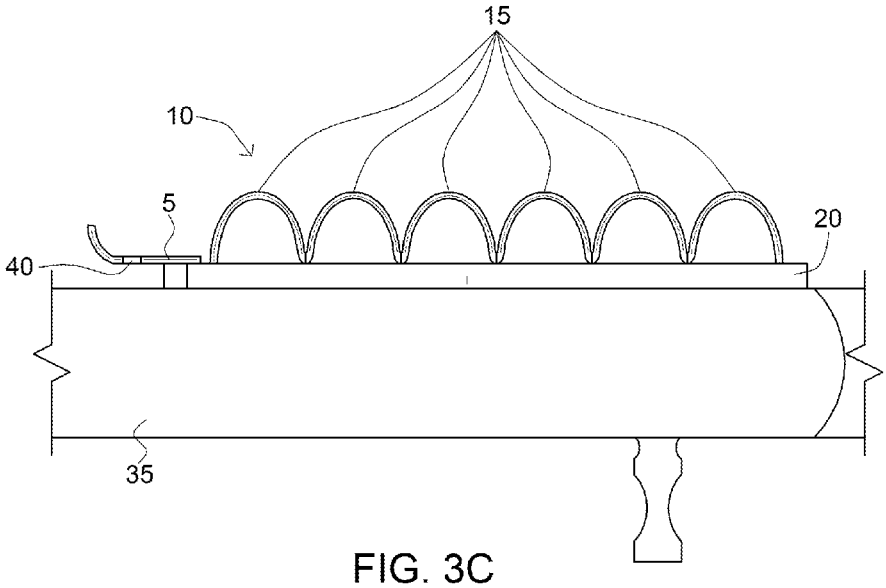
FIG. 3C depicts an example shotgun with an ammunition holder installed on the side of its receiver area, from the top view, according to one embodiment.
Figure 3D:
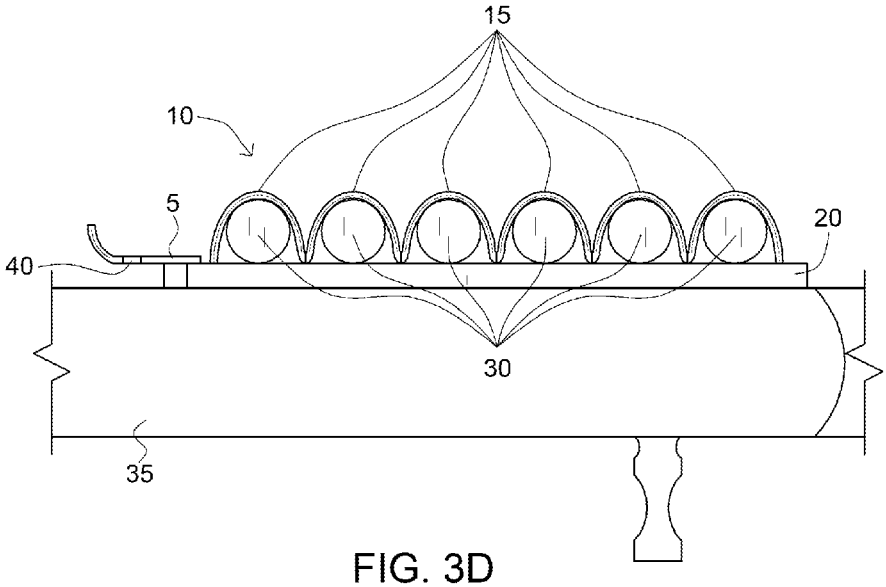
FIG. 3D depicts an example shotgun with an ammunition holder installed on the side of its receiver area, from the top view, with shotgun shells installed, according to one embodiment.
Figure 3E:
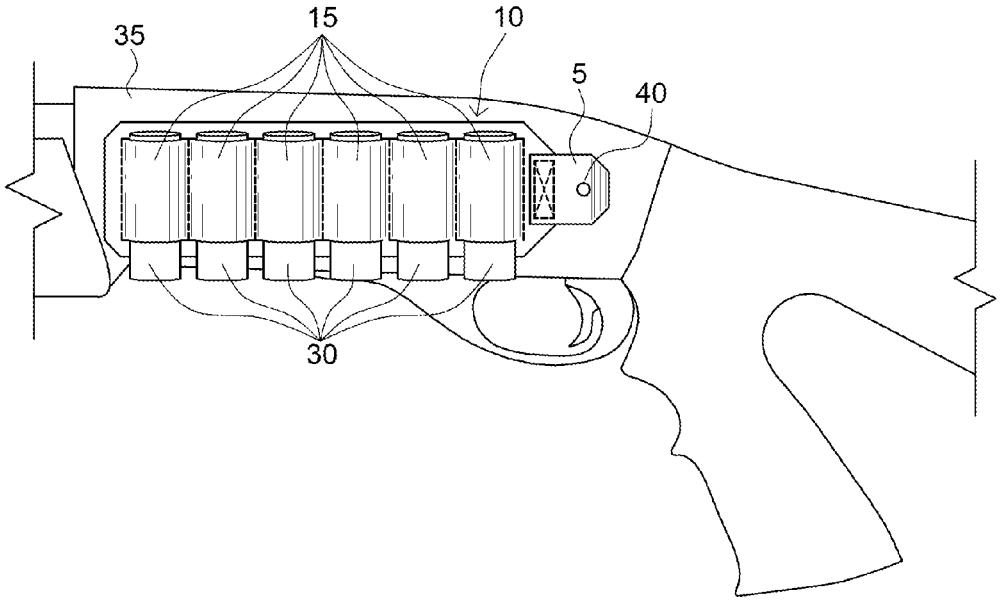
FIG. 3E depicts an example shotgun with an ammunition holder installed on the side of its receiver area, from the side view, with shotgun shells installed, according to one embodiment.
Figure 4:
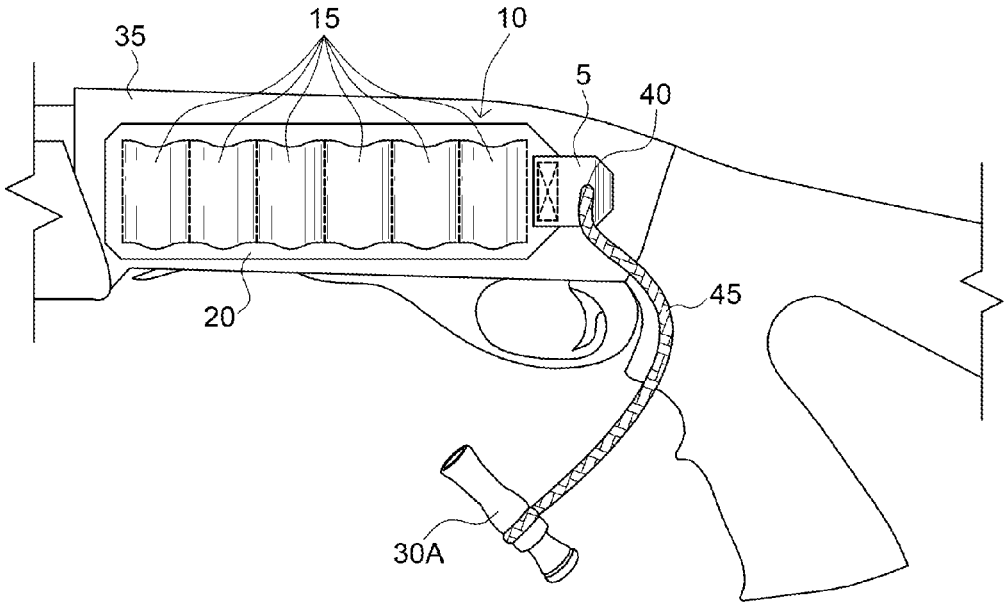
FIG. 4 depicts another embodiment of an ammunition holder with a lanyard attached to the tab member, and with an example of a non-ammunition piece of equipment, such as a game call, attached to the distal end of the lanyard. The game call can also be stored in one of the ammunition-shell holder members next to actual ammunition shells.
Figure 5:
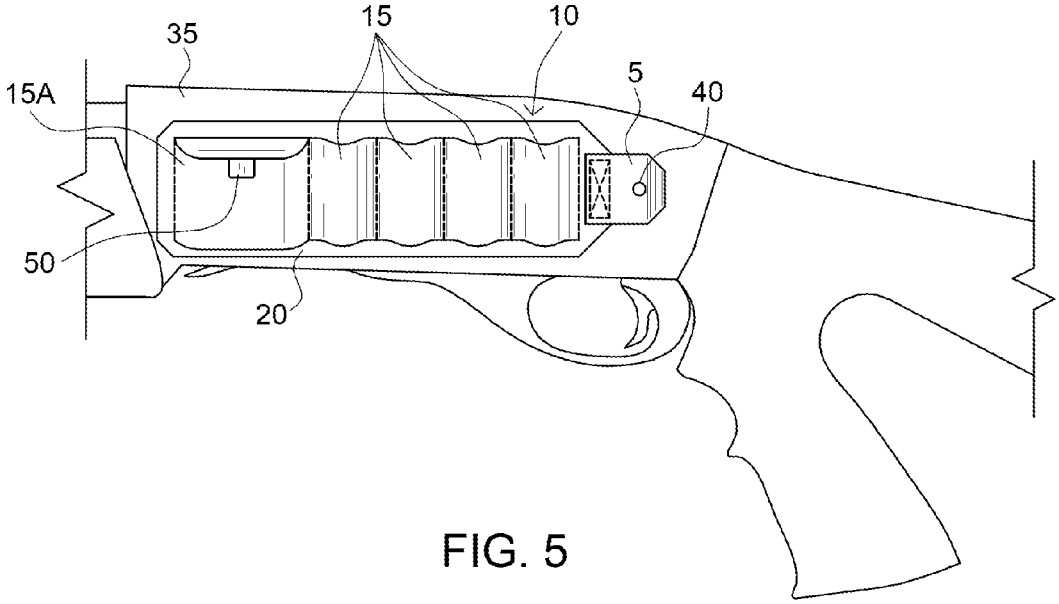
FIG. 5 depicts another embodiment of an ammunition holder with an additional pouch-type holder for ammunition or other hunter items, wherein the pouch-type holder has a top cover that can be securely closed by a fastening means; for example, a hook-and-loop flap coupler or mechanical snap.
Figure 6:
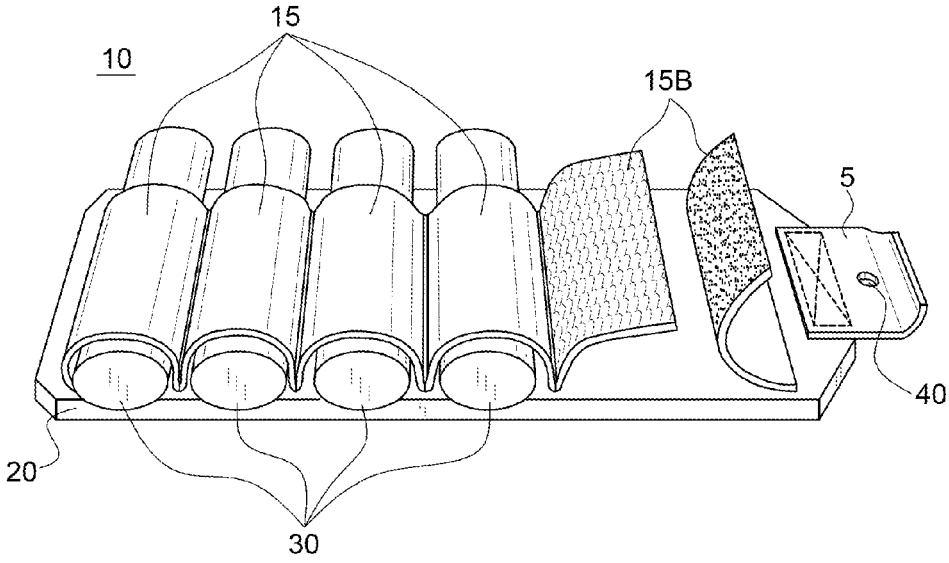
FIG. 6 depicts another embodiment of an ammunition holder with an additional adjustable ammunition-shell holder member adapted to allow a user to adjustably hold a piece of equipment such as ammunition or any other item useful to a hunter or target shooter. In this particular embodiment, the adjustable fitting is achieved by use of hook-and-loop strapping.

The present inventive concept is generally directed to a magnetic, detachable, side-mounted, ammunition carrier for a gun, specifically for a rifle or shotgun. Generally speaking, the carrier is detachably located by a user on one of the sides of ammunition-chamber loading region of a rifle or shotgun. In an embodiment, the ammunition carrier is comprised of a substantially rigid, magnetic substrate on which is a plurality of flexible, elastic, radially closed, loops/sleeves that are each adapted to receive a shotgun shell or other round of ammunition. In some variations, the elastic loops/sleeves can be comprised of any number of appropriate materials, including neoprene, polyurethane webbing, etc. One of the benefits of having fully flexible ammunition-shell holder sleeves/loops is that they can be flattened for storage, and can also be used/adapted to hold other useful items besides ammunition shells, unlike other ammunition-holder devices in the art that have fairly rigid, fixed size and shaped, ammunition-shell holders. In additional embodiments, the ammunition carrier allows for the easy mounting and access of extra ammunition without having to modify the firearm from its original equipment manufacturer (OEM) configuration. Moreover, in many other variations, the ammunition carrier is designed to facilitate the quick and easy removal and/or change-out of the ammunition carrier as ammunition is used up. In still more variations, the ammunition carrier is further equipped with a non-magnetic tab of sorts to aid a user in the easy detachment of the device from the metal side of the firearm.

Of particular note, in some embodiments, is that the ammunition carrier can be magnetically attached to any number of other surfaces with sufficient magnetic properties. In addition, the ammunition-carrier device can be adapted or used for holding other items useful to a sportsman in the field, such as a game call, for example. In yet more embodiments, the ammunition carrier need not be limited to shotgun shells, and the elastic loops/sleeves can easily be adapted to receive other types of rifle shells to be used in conjunction with various other types of hunting rifles.

Terminology

The terms and phrases as indicated in quotes (" ") in this section are intended to have the meaning ascribed to them in this Terminology section applied to them throughout this document, including the claims, unless clearly indicated otherwise in context. Further, as applicable, the stated definitions are to apply, regardless of the word or phrase's case, to the singular and plural variations of the defined word or phrase.

The term "or", as used in this specification and the appended claims, is not meant to be exclusive; rather, the term is inclusive, meaning "either or both".

References in the specification to "one embodiment", "an embodiment", "a preferred embodiment", "an alternative embodiment", "a variation", "one variation", and similar phrases mean that a particular feature, structure, or characteristic described in connection with the embodiment is included in at least an embodiment of the invention. The appearances of the phrase "in one embodiment" and/or "in one variation" in various places in the specification are not necessarily all meant to refer to the same embodiment.

The term "couple" or "coupled", as used in this specification and the appended claims, refers to either an indirect or a direct connection between the identified elements, components, or objects. Often, the manner of the coupling will be related specifically to the manner in which the two coupled elements interact.

The term "removable", "removably coupled", "readily removable", "readily detachable", "detachably coupled", and similar terms, as used in this patent application specification (including the claims and drawings), refer to structures that can be uncoupled from an adjoining structure with relative ease (i.e., non-destructively, and without a complicated or time-consuming process) and that can also be readily reattached or coupled to the previously adjoining structure.

Directional and/or relational terms such as, but not limited to, left, right, nadir, apex, top, bottom, vertical, horizontal, back, front, and lateral are relative to each other, are dependent on the specific orientation of an applicable element or article, are used accordingly to aid in the description of the various embodiments in this specification and the appended claims, and are not necessarily intended to be construed as limiting.

As applicable, the terms "about" or "generally", as used herein in the specification and appended claims, and unless otherwise indicated, means a margin of +−20%. Also, as applicable, the term "substantially" as used herein in the specification and appended claims, unless otherwise indicated, means a margin of +−10%. It is to be appreciated that not all uses of the above terms are quantifiable such that the referenced ranges can be applied.

The terms "flexibly rigid" and "substantially rigid", as used in this specification and the appended claims, refer to a structural integrity that allows a structure to substantially maintain its manufactured shape, yet allows for some flexing of the manufactured shape to facilitate effective applied uses of the manufactured structure. For example, in the case of the magnetic substrate that forms the base structure of some embodiments for the ammunition holder discussed in this specification and claims, the substantially rigid substrate can have some flex as the ammunition holder is magnetically attached and detached from a surface.

The term "rare-earth magnet", as used in this specification and the appended claims, refers to any magnet that is comprised of one or more of the rare earth (lanthanide) elements, which are metals that are ferromagnetic. Rare-earth magnetic elements can be magnetized like iron, but have Curie temperatures below room temperature and make particularly strong. Consequently, in pure form their magnetism only appears at low temperatures. However, practical rare-earth magnets are made of compounds of rare-earth element(s) and transitional metals such as iron, nickel, and cobalt, which raise their Curie temperatures well above room temperature.

First Embodiment—A Rifle-Mounted Hunter's Equipment Holder

This embodiment is generally directed to an ammunition holder generally used to store extra ammunition shells (e.g., rifle cartridges or shotgun shells) on the side of the region of the rifle or shotgun, wherein the ammunition holder can be adapted to hold/store other equipment useful to a hunter instead of or in addition to ammunition. It should be noted and appreciated by one skilled in the art that all references to hunters or other firearm users can be applied to military and/or law-enforcement users of firearms, and such users are contemplated throughout this disclosure.

Refer to FIGS. 1A-7. In an exemplary embodiment, the ammunition holder 10 has a substantially rigid substrate 20 with magnetic properties. In some variations, the substantially rigid substrate 20 includes a flexible, injection-molded magnetic sheet/strip of sufficient thickness to maintain rigidity, albeit with the ability to flex slightly, and the flexible magnetic material includes a flexible resin or binder such as vinyl. In another variation, the substantially rigid substrate 20 is comprised of at least two layers of materials, with at least one of the layers being comprised of flexible magnetic material, and at least one of the other layer(s) used (e.g., plastic, vulcanized rubber, etc.) used for establishing substantial structural rigidity. In still more variations, the substrate 20 is comprised of rare-earth magnets.

In other variations, the ammunition holder 10 further comprises a plurality of ammunition-shell holder members 15 disposed on the substantially rigid substrate 20, wherein each of the ammunition-shell holder members 15 is flexible and has elastic properties to allow for gripping an inserted ammunition shell 30 (or other hunter's equipment, as a hunter may deem appropriate). In common applications, each of the plurality of ammunition-shell holder members 15 is adapted to snuggly hold an ammunition shell 30 selected from a group comprised of a shotgun shell and/or a rifle cartridge.

In yet another variation, the interface between the substantially rigid substrate 20 and each ammunition-shell holder member 15 includes a depression 25 manufactured into the substrate 20 that is the length of the ammunition-shell holder member 15 and is adapted to hold or encapsulate a magnet 25 to facilitate the magnetic coupling of the ammunition holder 10 to a target surface. In some variations, each of this plurality of magnets is a rare-earth magnet. One reason for using a plurality of rare-earth magnets in this fashion is that many rare-earth magnets are relatively brittle (that is, non-flexible), so providing a plurality of such magnets in a substantially rigid substrate will facilitate some flexability of the entire ammunition holder 10. In even more variations, the substrate 20 used in conjunction with the plurality of rare-earth magnets 25 is comprised of castable urethane to effectively form one main substantially rigid, magnetic substrate 20.

In one embodiment, each ammunition-shell holder member 15 forms a tube-like loop of material that is radially closed, and that is open on at least one end. In yet another option on this theme, one or more ammunition-shell holder members 15 are substantially closed at one end, and detachably closed on the other (upper) end, wherein the detachable closing means can be as simple as a flap cover 50 that can be fixed in the closed position via a strap that employs a hook-and-loop coupling with the body of the ammunition-shell holder member 15, and such holder members 15 may be sized and adapted to holder equipment items 30A not limited to ammunition shells/cartridges 30. In still more variations, these ammunition-shell holder members 15 are substantially fabricated from a material selected from a group comprised of neoprene, polyurethane webbing, segmented polyurethane fiber, nylon fabric, rubber, and/or synthetic elastomeric fiber.

In some embodiments, the ammunition holder 10 includes a substantially rigid, non-magnetic, user-grip tab member 5 disposed at one end of the substantially rigid substrate 20, wherein the tab member 5 is adapted to allow a user to grip and exert leverage to detachably remove the ammunition holder 10 from a surface magnetically coupled to the substantially rigid substrate 20, wherein a target mounting location is comprised of ferritic or magnetic material. In variations, there is an aperture 40 (e.g., a round formed or drilled hole) disposed through the tab member 5. In still more optional variations, a lanyard 45 is attached to the tab member 5, with an example embodiment depicted in FIG. 4. The potential functionality of the lanyard 45 includes allowing for attaching the ammunition holder 10 to a structure using the lanyard 45. Other potential functionality of the lanyard 45 includes attaching a piece of hunter equipment (e.g., a game call) 30A that a hunter might alternately store in one of the plurality of ammunition-shell holder members 15 and then remove and use in the field; if a hunter drops the equipment, it will remain attached to the ammunition holder 10 via the lanyard 45. In optional variations, the lanyard 45 is of a type selected from a group that comprises elastic cords, leather cords/straps, braided metal cords, and/or fibrous cords. In still more variations, the lanyard 45 is mounted on the tab member 5 with a retractable lanyard 45 reel, well-known in the art. In yet another variation, such a retractable lanyard 45 reel can be mounted on the substantially rigid substrate 20, taking the place of one of more ammunition-shell holder members 15 that otherwise might be disposed at the location of the mounted retractable lanyard 45 reel. In another variation, the lanyard 45 is a spring-like coil made from a resilient material such as elastomeric plastic.

In yet more embodiments, at least one of the plurality of ammunition-shell holder members 15 is adapted to hold a non-ammunition piece of equipment 30A such as, for example, a game call, a hunting-scent container, a compass, a GPS device, a map, a knife, a multi-tool, or a portable light. On some of such variations, these alternative equipment items can be stored in a specially adapted ammunition-shell holder member 15A which is closed on the lower end and has a closable cover 50 on the upper end (an example embodiment depicted in FIG. 5). In yet more variations, these alternative equipment items may be attached to a lanyard 45, which in turn is attached to the tab member 5 via a fastening at the aperture 40 disposed in the tab member 5.

In additional variations, at least one of the plurality of ammunition-shell holder members 15 is adapted to be adjustably fitted to an inserted piece of equipment. For example, in one such alternate variation, at least one adjustable ammunition-shell holder member 15B (an example embodiment depicted in FIG. 6) is defined by a strap of material that is fixedly coupled at a point along the strap to the substantially rigid substrate 20; the strap of material has a "hook" part of a hook-and-loop coupling on one side, and has a "loop" part of a hook-and-loop coupling on the other side; and the strap of material can be made into a variable-sized holder by detachably coupling a portion of the "loop" part of the strap to a portion of the "hook" part of said strap. Obviously, these adjustable ammunition-shell holder members 15B can be manipulated to securely hold inserted ammunition shells/cartridges and/or other items useful to a hunter/user, wherein the inserted items have variable girths and where mere elasticity of a preformed and sized ammunition-shell holder member 15 may not be adequate to snuggly hold onto and/or accommodate some items.

In even more embodiments, the substantially rigid substrate 20 is sized and adapted to magnetically couple to a firearm, wherein the target mounting location on the firearm is comprised of ferritic or magnetic material, in a manner that can include:

- the side of a shotgun 35 at or near the shotgun's receiver region; or
- the side of a rifle 35 at or near the rifle's chamber region.

Figure 7:
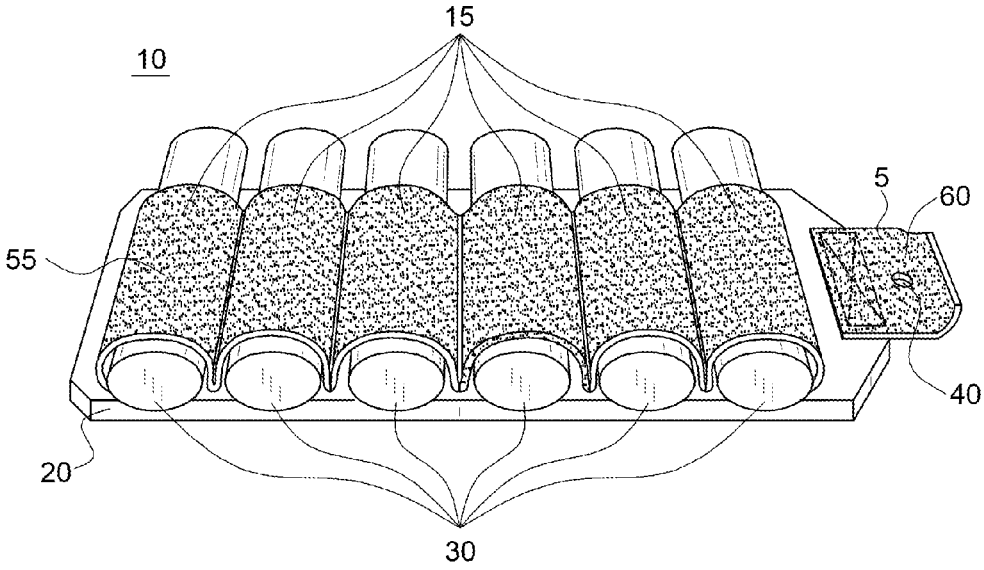
FIG. 7 depicts another embodiment of an ammunition holder from the top-side perspective, with shotgun shells installed in each flexible shell-holding sleeve/tube, wherein the outer surfaces of the ammunition-shell holders and the tab member comprise material that can act as one part of a hook-and-loop coupling.

In an another embodiment, referring to FIG. 7, the plurality of ammunition-shell holder members 15 has an outer surface 55 that is substantially made of a material that can act as a mating surface in a hook-and-loop coupling to another surface having a compatible hook-and-loop mating surface. This feature can allow a user to affix the ammunition holder 10 to a surface via a hook-and-loop coupling, even if the substantially rigid, often magnetically coupled, substrate 20 is not so equipped to facilitate such a coupling. In some implementations of this concept, the ammunition-shell holder members 15 alternately have "hook" or "loop" material disposed on the outer surface 55, as this makes the overall ammunition holder 10 equipped to be detachably coupled to surfaces with either "hook" or "loop" type materials. Similarly, in a variation, the user-grip tab member 5 is further comprised of at least one surface 60 that is substantially made of a material that can act as a mating surface in a hook-and-loop coupling to another surface having a compatible hook-and-loop mating surface.

In yet another variation of this embodiment, a strip of ferrite or magnetic material is adhesively mounted onto an otherwise non-ferritic and non-magnetic surface of a firearm 35 such that the ammunition holder 10 can be detachably mounted onto the firearm 35 via the substantially rigid, magnetic substrate 20. In some implementations of this variation, a strip of magnetic material is securely attached to a surface on a firearm 35, and the ammunition holder 10 has a substantially rigid substrate 20 that is not magnetic, but has ferritic properties to allow the ammunition holder 10 to couple to the strip of magnetic material disposed on the firearm 35.

Second Embodiment—A Method of Making a Rifle-Mounted Hunter's Equipment Holder

This embodiment is generally directed to a method of making an ammunition holder generally used to store extra ammunition shells (e.g., rifle cartridges or shotgun shells) on the side of the region of the rifle or shotgun, wherein the ammunition holder can be adapted to hold/store other equipment useful to a hunter instead of or in addition to ammunition. It should be noted and appreciated by one skilled in the art that all references to hunters or other firearm users can be applied to military and/or law-enforcement users of firearms, and such users are contemplated throughout this disclosure.

Refer to FIGS. 1A-7. The method comprises the steps of:

- Providing a substantially rigid substrate 20 with magnetic properties;
- Providing a plurality of ammunition-shell holder members 15 disposed on the substantially rigid substrate 20, wherein each of the ammunition-shell holder members 15 is flexible and has elastic properties to allow for gripping an inserted ammunition shell 30; and
- Providing a substantially rigid, non-magnetic, user-grip tab member 5 disposed at one end of the substantially rigid substrate 20, wherein the tab member 5 is adapted to allow a user to grip and exert leverage to detachably remove the ammunition holder 10 from a surface magnetically coupled to the substantially rigid substrate 20.

This embodiment can be enhanced wherein at least one of the plurality of ammunition-shell holder members 15 is adapted to snuggly hold an ammunition shell 30 selected from a group comprised of a shotgun shell and a rifle cartridge.

This embodiment can be enhanced wherein at least one of the plurality of ammunition-shell holder members 15 is adapted to hold a non-ammunition piece of equipment 30A selected from a group comprised of a game call, a hunting-scent container, a compass, a GPS device, a map, a knife, a multi-tool, and/or a portable light. On some of such variations, the method includes the step of providing a specially adapted ammunition-shell holder member 15A which is closed on the lower end and has a closable cover 50 on the upper end.

This embodiment can be enhanced wherein at least one of the plurality of ammunition-shell holder members 15 is adapted to be adjustably fitted to an inserted piece of equipment. In even more variations, at least one adjustable ammunition-shell holder member 15 is defined by a strap of material that is fixedly coupled at a point along the strap to the substantially rigid substrate 20; the strap of material has a "hook" part of a hook-and-loop coupling on one side, and has a "loop" part of a hook-and-loop coupling on the other side; and the strap of material can be made into a variable-sized holder by detachably coupling a portion of the "loop" part of the strap to a portion of said "hook" part of the strap.

This embodiment can be enhanced wherein at least one of the plurality of ammunition-shell holder members 15 is substantially fabricated from a material selected from a group comprised of neoprene, polyurethane webbing, segmented polyurethane fiber, nylon fabric, rubber, and/or synthetic elastomeric fiber.

This embodiment can be enhanced by further comprising the step of providing an aperture 40 disposed through said tab member. In a related variation, this embodiment can be enhanced by further comprising the step of providing a lanyard 45 attached to the tab member 5. In optional variations, the lanyard 45 is of a type selected from a group that comprises elastic cords, leather cords/straps, braided metal cords, and/or fibrous cords. In still more variations, the lanyard 45 is mounted on the tab member 5 with a retractable lanyard 45 reel, well-known in the art. In yet another variation, such a retractable lanyard 45 reel can be mounted on the substantially rigid substrate 20, taking the place of one of more ammunition-shell holder members 15 that otherwise might be disposed at the location of the mounted retractable lanyard 45 reel. In other variations, the lanyard 45 is a spring-like coil made from a resilient material such as elastomeric plastic. In another variation, the lanyard 45 is attached on its distal end to a non-ammunition piece of equipment 30A selected from a group comprised of a game call, a hunting-scent container, a compass, a GPS device, a map, a knife, a multi-tool, and/or a portable light.

This embodiment can be further enhanced wherein at least one of the plurality of ammunition-shell holder members 15 is adapted to be adjustably fitted to an inserted piece of equipment. For example, in one such alternate variation, at least one adjustable ammunition-shell holder member 15B is defined by a strap of material that is fixedly coupled at a point along the strap to the substantially rigid substrate 20; the strap of material has a "hook" part of a hook-and-loop coupling on one side, and has a "loop" part of a hook-and-loop coupling on the other side; and the strap of material can be made into a variable-sized holder by detachably coupling a portion of the "loop" part of the strap to a portion of the "hook" part of said strap. Obviously, these adjustable ammunition-shell holder members 15B can be manipulated to securely hold inserted ammunition shells/cartridges and/or other items useful to a hunter/user, wherein the inserted items have variable girths and where mere elasticity of a preformed and sized ammunition-shell holder member 15 may not be adequate to snuggly hold onto and/or accommodate some items.

This embodiment can be enhanced wherein the substantially rigid substrate 20 is sized and adapted to magnetically couple to a firearm, wherein the target mounting location on the firearm is comprised of terrific or magnetic material, in a manner that can include:

the side of a shotgun 35 at or near the shotgun's receiver region; or the side of a rifle 35 at or near the rifle's chamber region.

This embodiment can be enhanced wherein the plurality of ammunition-shell holder members 15 has an outer surface 55 that is substantially made of a material that can act as a mating surface in a hook-and-loop coupling to another surface having a compatible hook-and-loop mating surface.

This embodiment can be enhanced wherein the user-grip tab member 5 is further comprised of at least one surface 60 that is substantially made of a material that can act as a mating surface in a hook-and-loop coupling to another surface having a compatible hook-and-loop mating surface.

Third Embodiment—A Method of Using a Rifle-Mounted Hunter's Equipment Holder

This embodiment is generally directed to a method of using an ammunition holder generally used to store extra ammunition shells (e.g., rifle cartridges or shotgun shells) on the side of the region of the rifle or shotgun, wherein the ammunition holder can be adapted to hold/store other equipment useful to a hunter instead of or in addition to ammunition. It should be noted and appreciated by one skilled in the art that all references to hunters or other firearm users can be applied to military and/or law-enforcement users of firearms, and such users are contemplated throughout this disclosure.

Refer to FIGS. 1A-7. The method comprises the steps of:

Inserting at least one shell of firearm ammunition 30 into a ammunition-shell holder member 15 mounted on the substantially rigid substrate 20;

Attaching the substantially rigid substrate 20, with the inserted at least one firearm ammunition shell 30, to a firearm 35 in a manner that can include:

the side of a shotgun 35 at or near the shotgun's receiver region, or the side of a rifle 35 at or near the rifle's chamber region; and As necessary, removing said at least one shell of firearm ammunition 30 from the ammunition holder 10 and loading the shell 30 into the firearm 35.

This embodiment can be enhanced by further comprising the steps of:

Grasping the user-grip tab member 5 and exerting leverage to detachably remove the ammunition holder 10 from the firearm 10; and As necessary, attaching either another ammunition holder 10 containing at least one firearm-ammunition shell 30 or the original ammunition holder 10 with at least one newly loaded firearm-ammunition shell 30 to the side of the firearm 35.

This embodiment can be enhanced by further comprising the step of inserting at least one piece of non-ammunition equipment into at least one of the plurality of ammunition-shell holder members 15. In variations, this embodiment can be enhanced wherein the non-ammunition piece of equipment 30A is selected from a group comprised of a game call, a hunting-scent container, a compass, a GPS device, a map, a knife, a multi-tool, and/or a portable light.

Alternative Embodiments and Other Variations

The various embodiments and variations thereof described herein and/or illustrated in the accompanying Figures are merely exemplary and are not meant to limit the scope of the inventive disclosure. It should be appreciated that numerous variations of the invention have been contemplated as would be obvious to one of ordinary skill in the art with the benefit of this disclosure.

Hence, those ordinarily skilled in the art will have no difficulty devising a myriad of obvious variations and improvements to the invention, all of which are intended to be encompassed within the scope of the claims which follow.

What is claimed is:

1. A combination cartridge holder comprising:

a firearm having a magnetic portion;

a rigid substrate with magnetic properties removably and magnetically coupled to said magnetic portion of said firearm;

a plurality of cartridge holder members disposed on an outer surface of said rigid substrate, wherein each of said cartridge holder members is flexible and has elastic properties to allow for gripping an inserted cartridge;

a cartridge removably inserted into one of said plurality of cartridge holder members; and a rigid, non-magnetic, user-grip tab member disposed at one end of and on the outer surface of said rigid substrate, wherein said tab member is adapted to allow a user to grip and exert leverage to detachably remove said cartridge holder from said magnetic portion of said firearm.

2. The combination cartridge holder of claim 1, wherein at least one of said plurality of cartridge holder members is adapted to snugly hold an ammunition shell selected from the group consisting of a shotgun shell and a rifle cartridge.

3. The combination cartridge holder of claim 1, wherein at least one of said plurality of cartridge holder members is adapted to hold a non-ammunition piece of equipment selected from the group consisting of a game call, a hunting-scent container, a compass, a GPS device, a map, a knife, a multi-tool, and a portable light.

4. The combination cartridge holder of claim 1, wherein at least one of said plurality of cartridge holder members is adapted to be adjustably fitted to an inserted piece of equipment.

5. The combination cartridge holder of claim 4, wherein:

said at least one adjustable cartridge holder member is defined by a strap of material that is fixedly coupled at a point along said strap to said rigid substrate;

said strap of material has a hook part of a hook-and-loop coupling on one side, and has a loop part of a hook-and-loop coupling on the other side; and said strap of material can be made into a variable-sized holder by detachably coupling a portion of said loop part of said strap to a portion of said hook part of said strap.

6. The combination cartridge holder of claim 1, wherein at least one of said plurality of cartridge holder members is substantially fabricated from a material selected from the group consisting of neoprene, polyurethane webbing, segmented polyurethane fiber, nylon fabric, rubber, and synthetic elastomeric fiber.

7. The combination cartridge holder of claim 1, further comprising an aperture disposed through said tab member.

8. The combination cartridge holder of claim 7, further comprising a lanyard attached to said tab member.

9. The combination cartridge holder of claim 1, wherein said rigid substrate is sized and adapted to magnetically couple to a firearm in a manner selected from the group consisting of:

a side of a shotgun at or near a receiver region of said shotgun; and a side of a rifle at or near a chamber region of said rifle.

10. The combination cartridge holder of claim 1, wherein said plurality of cartridge holder members has an outer surface that is substantially made of a material that can act as a mating surface in a hook-and-loop coupling to another surface having a compatible hook-and-loop mating surface.

11. The combination cartridge holder of claim 1, wherein said user-grip tab member is further comprised of at least one surface that is substantially made of a material that can act as a mating surface in a hook-and-loop coupling to another surface having a compatible hook-and-loop mating surface.

12. A method of making a combination cartridge holder comprising the steps of:

providing a firearm having a magnetic portion;

providing a rigid substrate with magnetic properties removably and magnetically coupled to said magnetic portion of said firearm;

providing a plurality of cartridge holder members disposed on an outer surface of said rigid substrate, wherein each of said cartridge holder members is flexible and has elastic properties to allow for gripping an inserted cartridge;

inserting a cartridge into one of said plurality of cartridge holder members; and providing a rigid, non-magnetic, user-grip tab member disposed at one end of and on the outer surface of said rigid substrate, wherein said tab member is adapted to allow a user to grip and exert leverage to detachably remove said cartridge holder from said magnetic portion of said firearm.

13. The method of claim 12, wherein at least one of said plurality of cartridge holder members is adapted to be adjustably fitted to an inserted piece of equipment.

14. The method of claim 13, wherein:

said at least one adjustable cartridge holder member is defined by a strap of material that is fixedly coupled at a point along said strap to said rigid substrate;

said strap of material has a hook part of a hook-and-loop coupling on one side, and has a loop part of a hook-and-loop coupling on the other side; and said strap of material can be made into a variable-sized holder by detachably coupling a portion of said loop part of said strap to a portion of said hook part of said strap.

15. The method of claim 12, further comprising the step of:

providing an aperture disposed through said tab member.

16. The method of claim 15, further comprising the step of:

providing a lanyard attached to said tab member.

17. A method of using the combination cartridge holder according to claim 1, comprising the steps of:

inserting at least one shell of firearm ammunition into one of the plurality of cartridge holder members mounted on said rigid substrate;

removing said rigid substrate from the firearm it is magnetically coupled to;

attaching said rigid substrate, with said inserted at least one firearm ammunition shell, to a firearm in a manner selected from the group consisting of:

magnetically to a side of a shotgun at or near a receiver region of said shotgun; and magnetically to a side of a rifle at or near a chamber region of said rifle;

as necessary, removing said at least one shell of firearm ammunition from said cartridge holder member and loading said shell into said firearm.

18. The method of claim 17, further comprising the steps of:

grasping said user-grip tab member and exerting leverage to detachably remove said cartridge holder from said firearm; and as necessary, attaching either another combination cartridge holder containing at least one firearm-ammunition shell or the original combination cartridge holder with at least one newly loaded firearm-ammunition shell to a side of said firearm.

19. The method of claim 18, further comprising the step of:

inserting at least one piece of non-ammunition equipment into at least one of said plurality of cartridge holder members, wherein said non-ammunition piece of equipment is selected from the group consisting of a game call, a hunting-scent container, a compass, a GPS device, a map, a knife, a multi-tool, and a portable light.

20. A combination cartridge holder comprising:

a firearm having a magnetic portion;

a rigid substrate with magnetic properties removably and magnetically coupled to said magnetic portion of said firearm;

a plurality of cartridge holder members disposed on an outer surface of said rigid substrate, wherein (i) each of said cartridge holder members is flexible and has elastic properties to allow for gripping an inserted cartridge, (ii) one of said plurality of cartridge holder members is adjustable via a hook and loop coupling along a longitudinal axis of said adjustable cartridge holder member, and (iii) at least one of said plurality of cartridge holder members has an outer surface that is substantially made of a material that can act as a mating surface in a hook-and-loop coupling to another surface having a compatible hook-and-loop mating surface;

a cartridge removably inserted into one of said plurality of cartridge holder members; and a rigid, non-magnetic, user-grip tab member disposed at one end of and on the outer surface of said rigid substrate, wherein said tab member (i) is adapted to allow a user to grip and exert leverage to detachably remove said cartridge holder from said magnetic portion of said firearm, (ii) has an aperture disposed through said tab member, and (iii) includes a lanyard removably coupled to said tab member via said aperture.

* * * * *